US011628488B2

(12) United States Patent
Chang

(10) Patent No.: US 11,628,488 B2
(45) Date of Patent: Apr. 18, 2023

(54) METHOD FOR MANUFACTURING OPERATION ROD OF WRENCH ASSEMBLY FOR DISASSEMBLING FAN CLUTCH, AND PRODUCT AND WRENCH ASSEMBLY THEREOF

(71) Applicant: CHIUANYOU METAL CO., LTD., Taichung (TW)

(72) Inventor: Chin-Chung Chang, Taichung (TW)

(73) Assignee: CHIUANYOU METAL CO., LTD., Taichung (TW)

( * ) Notice: Subject to any disclaimer, the term of this patent is extended or adjusted under 35 U.S.C. 154(b) by 142 days.

(21) Appl. No.: 17/241,623

(22) Filed: Apr. 27, 2021

(65) Prior Publication Data

US 2022/0339693 A1 Oct. 27, 2022

(51) Int. Cl.

| | |
|---|---|
| ***B21K 5/18*** | (2006.01) |
| ***B25B 27/00*** | (2006.01) |
| ***B21J 5/02*** | (2006.01) |

(52) U.S. Cl.

CPC ..... *B21K 5/18* (2013.01); *B21J 5/025* (2013.01); *B25B 27/0064* (2013.01)

(58) Field of Classification Search

CPC ... B21K 1/06; B21K 1/10; B21K 1/74; B21K 1/762; B21K 5/16; B21K 5/18; B21J 5/02; B21J 5/027; B21J 13/02; B21J 5/025

See application file for complete search history.

(56) References Cited

U.S. PATENT DOCUMENTS

| | | | | | |
|---|---|---|---|---|---|
| 1,707,543 | A * | 4/1929 | Stocking | B21K 1/74 | 72/341 |
| 1,711,083 | A * | 4/1929 | Brungardt | B21K 5/16 | 81/177.1 |
| 3,818,746 | A * | 6/1974 | Fujita | B21K 1/766 | 72/356 |
| 4,202,082 | A * | 5/1980 | Williams | F16C 11/0614 | 72/356 |
| 4,543,812 | A * | 10/1985 | Theobald | B21J 5/02 | 72/359 |
| 5,878,491 | A * | 3/1999 | Morgen | B21K 1/766 | 29/888.091 |

FOREIGN PATENT DOCUMENTS

| | | | | |
|---|---|---|---|---|
| JP | 4-059146 A * | 2/1992 | ..... | B21J 13/02 |
| WO | 2018/070758 A1 * | 4/2018 | ..... | B21K 1/76 |

OTHER PUBLICATIONS

WO 2012/065982 A1, Schulze et al., May 2012.*

* cited by examiner

*Primary Examiner* — Edward T Tolan

(74) *Attorney, Agent, or Firm* — Muncy, Geissler, Olds & Lowe, P.C.

(57) ABSTRACT

A method for manufacturing an operation rod of a wrench assembly for disassembling a fan clutch, including following steps of: preparing a rod material; fixing the rod material on a forging mold; carrying out a forging process to produce a semi-finished head; carrying out a cutout process, cutting the remainder structure out of the semi-finished head; obtaining a finished product of a head portion, the head portion including two wing plates and a shaft which are integrally formed.

4 Claims, 13 Drawing Sheets

METHOD FOR MANUFACTURING OPERATION ROD OF WRENCH ASSEMBLY FOR DISASSEMBLING FAN CLUTCH, AND PRODUCT AND WRENCH ASSEMBLY THEREOF

BACKGROUND OF THE INVENTION

Field of the Invention

The present invention relates to a wrench, and more particularly to a method for manufacturing an operation rod of a wrench assembly for disassembling a fan clutch, and a product and the wrench assembly thereof.

Description of the Prior Art

A fan is one of the important components of the engine cooling system of a car, and its main function is to maintain the engine to work within a normal temperature range without being overheat. A fan clutch is used to connect the fan and an engine shaft, and the fan clutch changes a rotation speed of the fan based on the temperature variation. For example, if the engine is in a low temperature, the fan rotates slowly; and if the engine is in a high temperature, the fan rotates fast to effectively dissipate heat. This type of fan clutches is fixed to a rotation shaft via a nut.

When the fan clutch is broken and needs to be replaced, the nut needs to be screwed loose first. However, if the fan is surrounded by a lot of foreign objects, it would be hard for a maintenance staff to engage with the nut via a random hand tool, and because of the limited space, it would be hard for the maintenance staff to drive the nut loose. Therefore, the maintenance staff needs a wrench assembly particularly for disassemble a fan.

However, a structure of an operation rod of the wrench assembly for disassemble a fan is too loose and not durable, and it requires many manufacturing procedures to manufacture the operation rod, so the productivity is not preferable. Therefore, the present invention has arisen to mitigate and/or obviate the afore-described disadvantages.

SUMMARY OF THE INVENTION

The major object of the present invention is to provide a method for manufacturing an operation rod of a wrench assembly for disassembling a fan clutch, an operation rod can be integrally made through forging quickly, and the operation rod has a great structure strength.

To achieve the above and other objects, a method for manufacturing an operation rod of a wrench assembly for disassembling a fan clutch, including following steps of: preparing a rod material, the rod material includes a rod body and a head portion which is connected to the rod body; fixing the rod material on a forging mold; carrying out a forging process, making the forging mold impact and press the head portion along a processing direction to produce a semi-finished head, the semi-finished head includes two semi-finished structures and a remainder structure which is connected to the two semi-finished structures, the remainder structure extends in a flat shape, the two semi-finished structures are connected to two opposite side faces of the remainder structure on the processing direction, each said semi-finished structure includes two ear portions and a semi-cylinder, the two ear portions are arranged spacingly on a direction lateral to the processing direction, the semi-cylinder is connected to the two ear portions to define an interior space, the remainder structure includes a first remainder portion and a second remainder portion, the first remainder portion is outside of the interior space, and the second remainder portion is located in the interior space and connected to the semi-cylinder and the two ear portions; carrying out a cutout process, cutting the remainder structure out of the semi-finished head; obtaining a finished product of a head portion, the head portion includes two wing plates and a shaft, each said wing plate is constructed by the two ear portions of the two semi-finished structures neighboring to each other on the processing direction, and the shaft is constructed by the two semi-cylinders of the two semi-finished structures.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
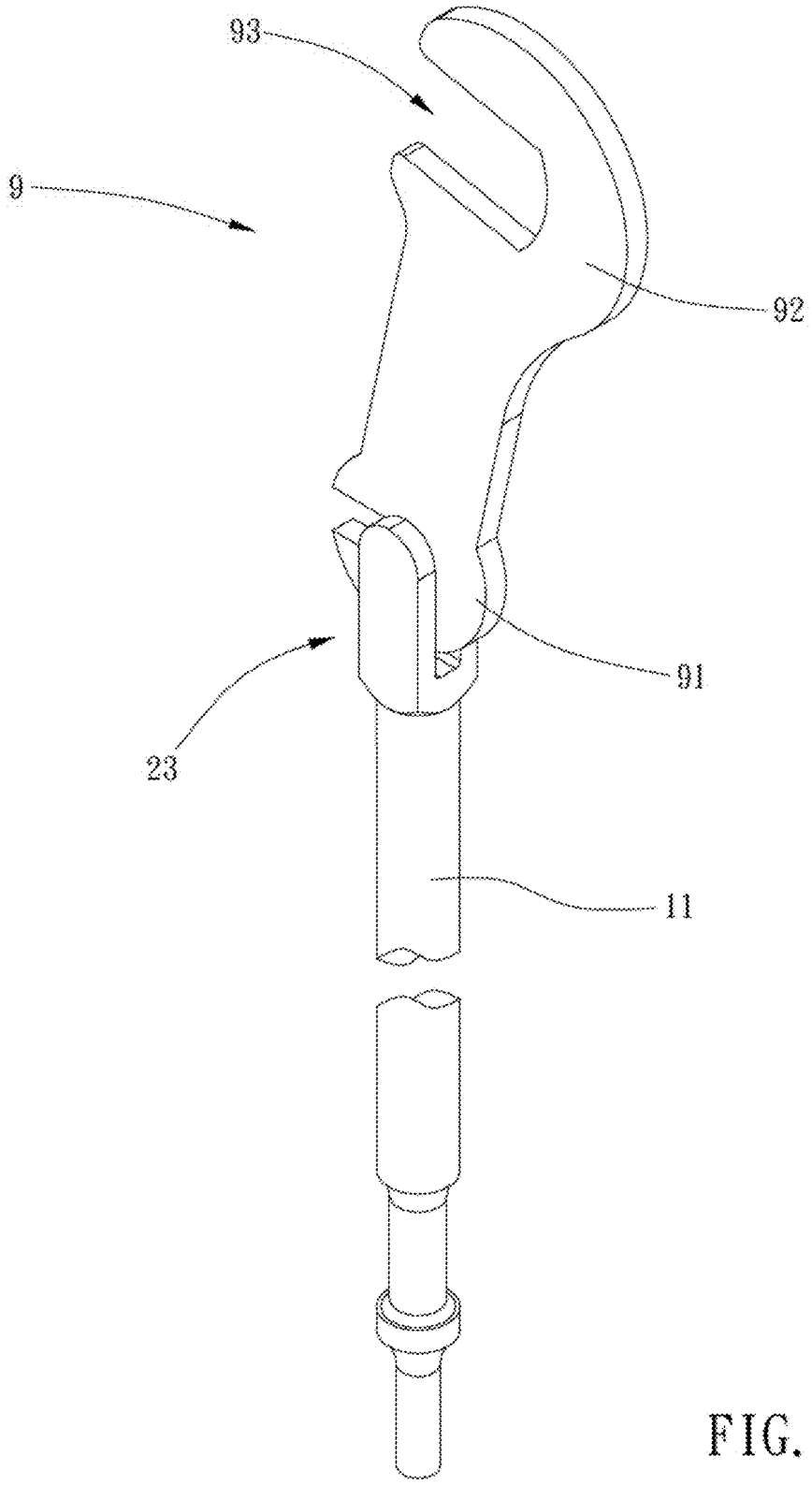
FIG. 1 is a stereogram of a wrench assembly of an embodiment of the present invention.
Figure 2:
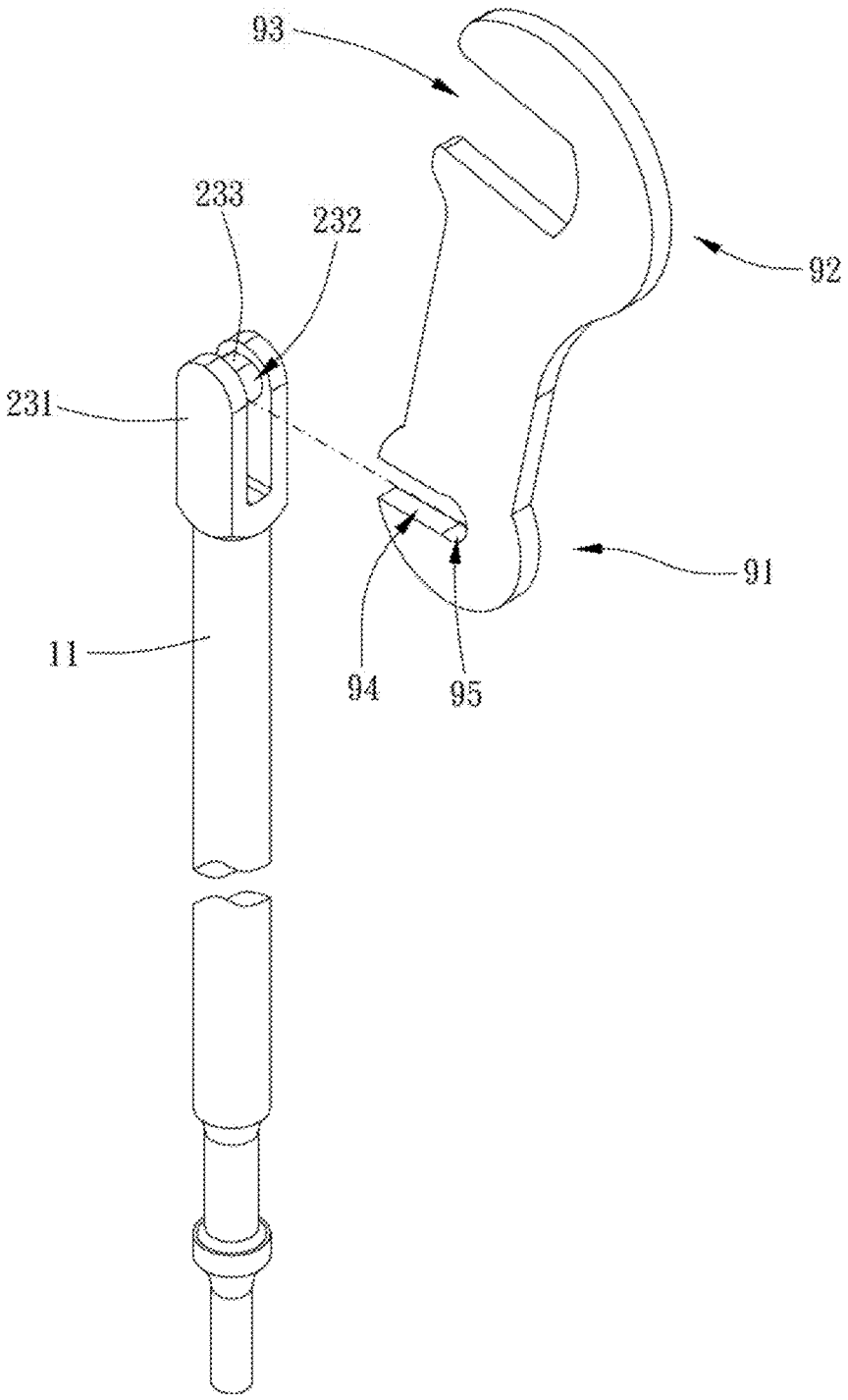
FIG. 2 is a breakdown view of FIG. 1.
Figure 3:
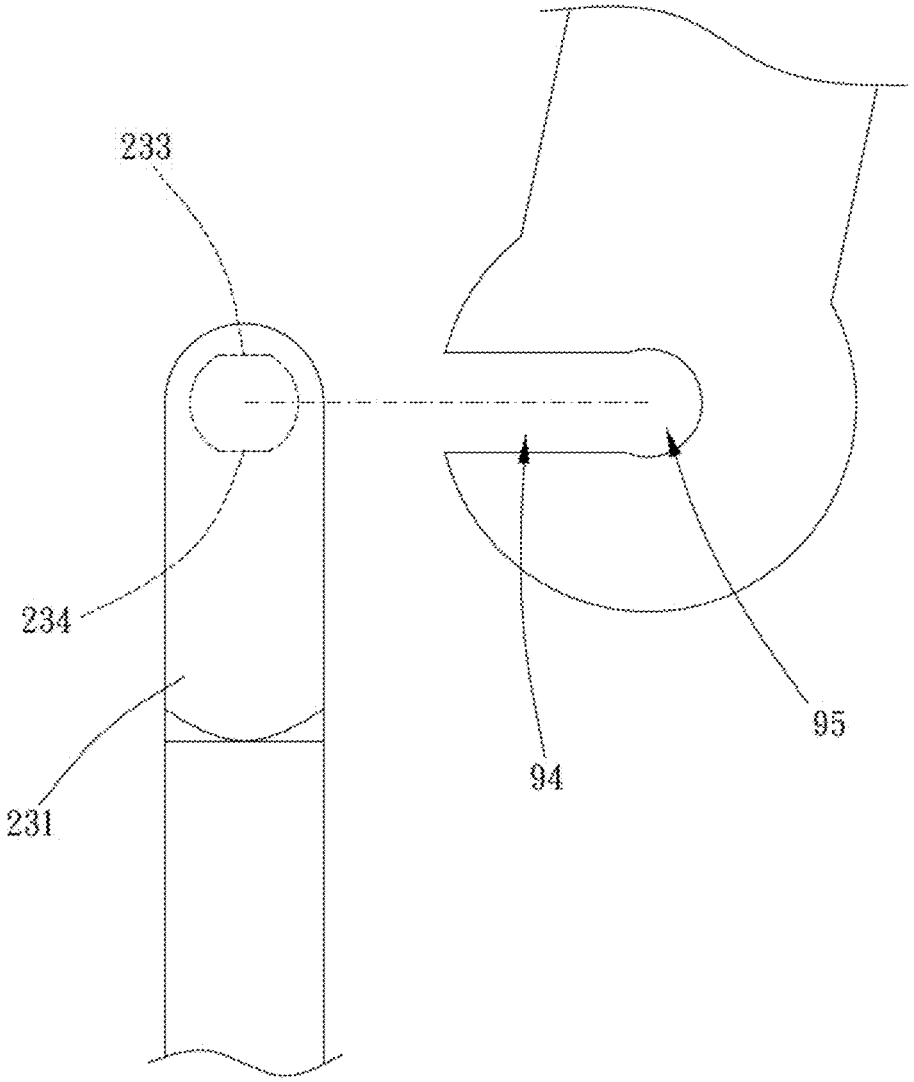
FIG. 3 is a partially perspective front view of FIG. 2.
Figure 4:
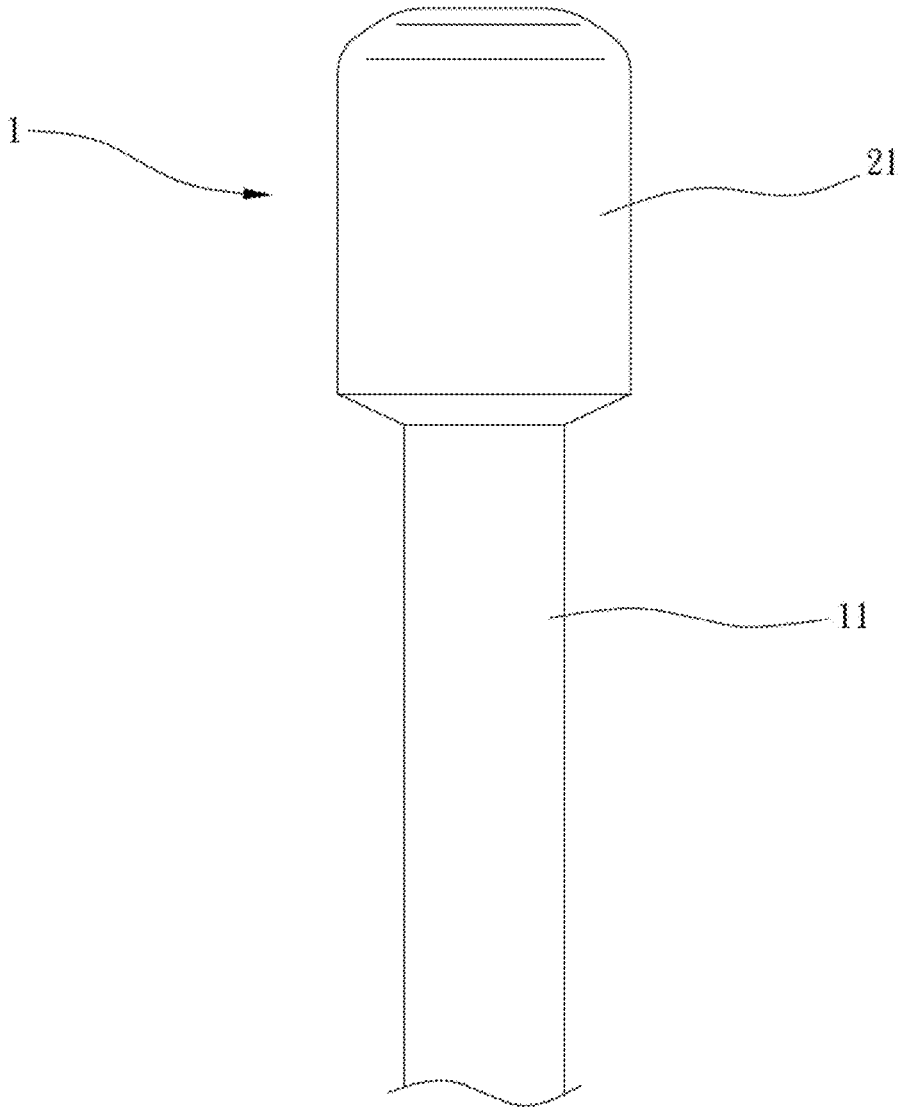
FIG. 4 is a drawing showing a head portion of the embodiment of the present invention.
Figure 5:
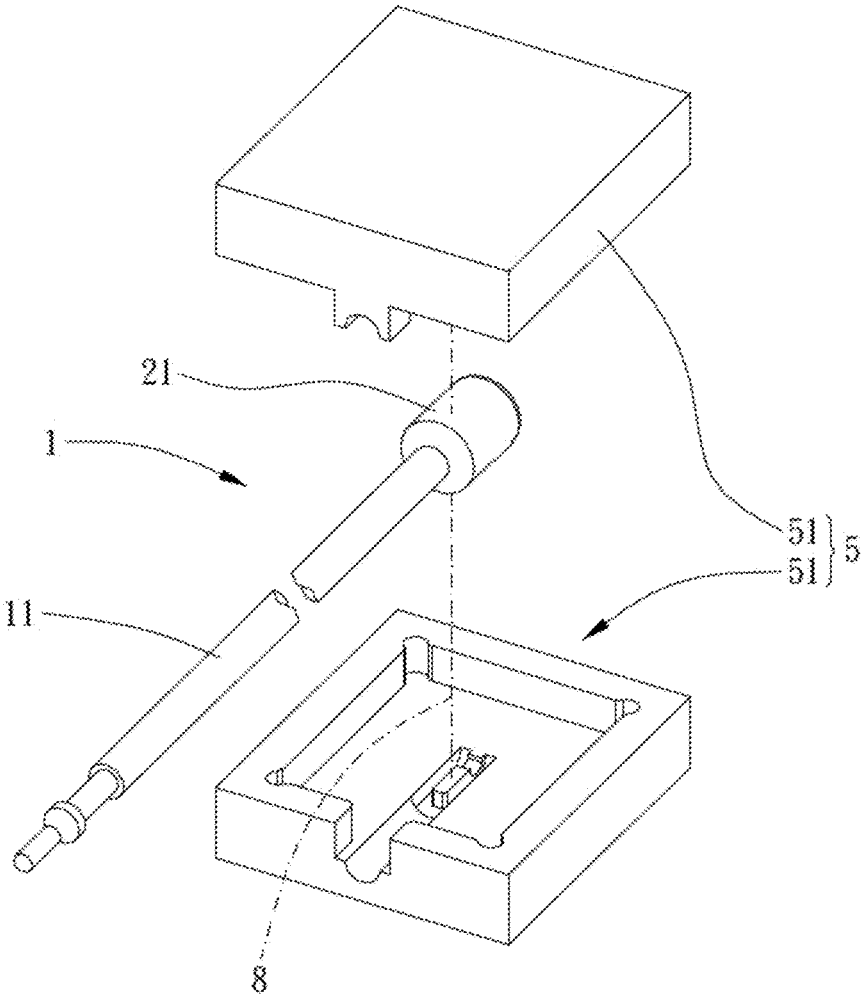
FIG. 5 is a drawing showing forging steps of the embodiment of the present invention.
Figure 6:
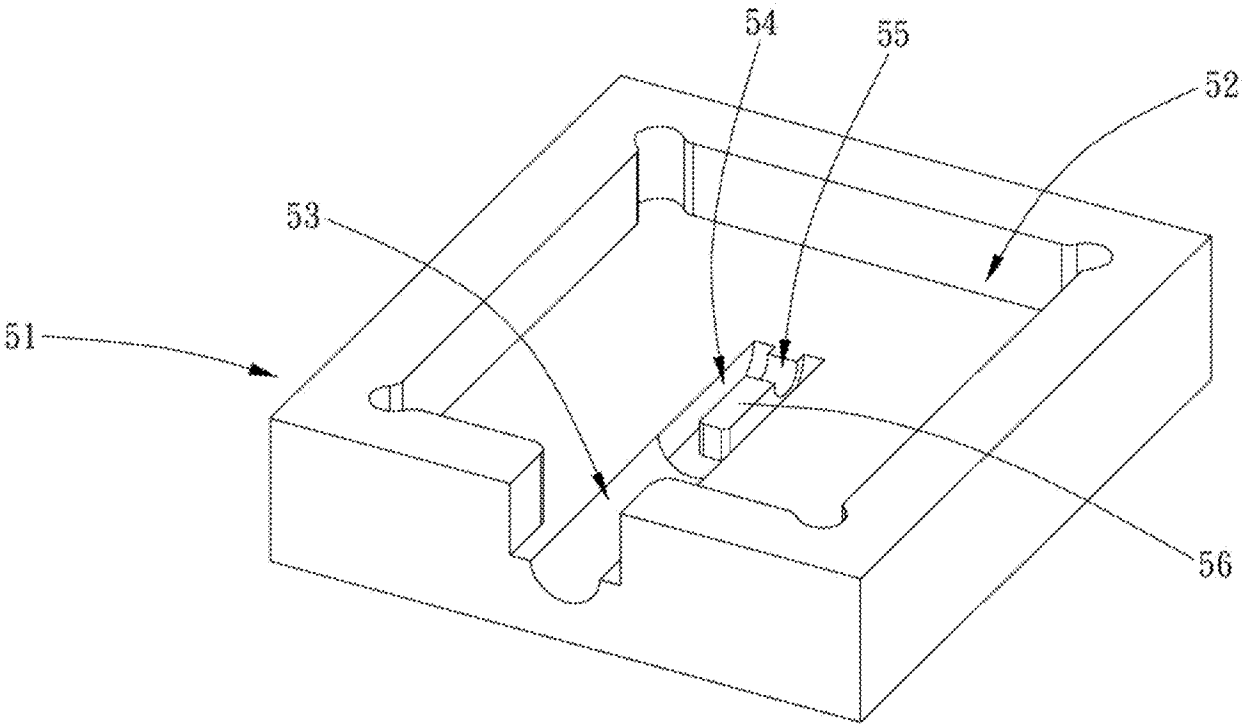
FIG. 6 is a drawing showing a forging mold of the embodiment of the present invention.
Figure 7:
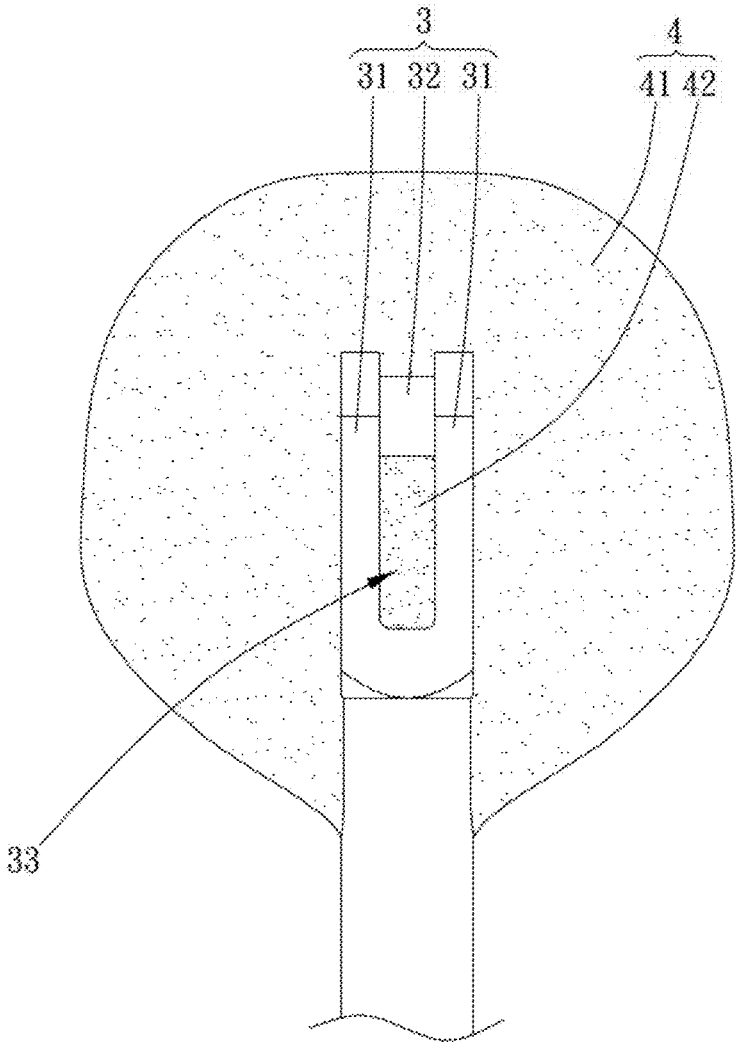
FIG. 7 is a drawing showing a head portion of the embodiment of the present invention.
Figure 8:
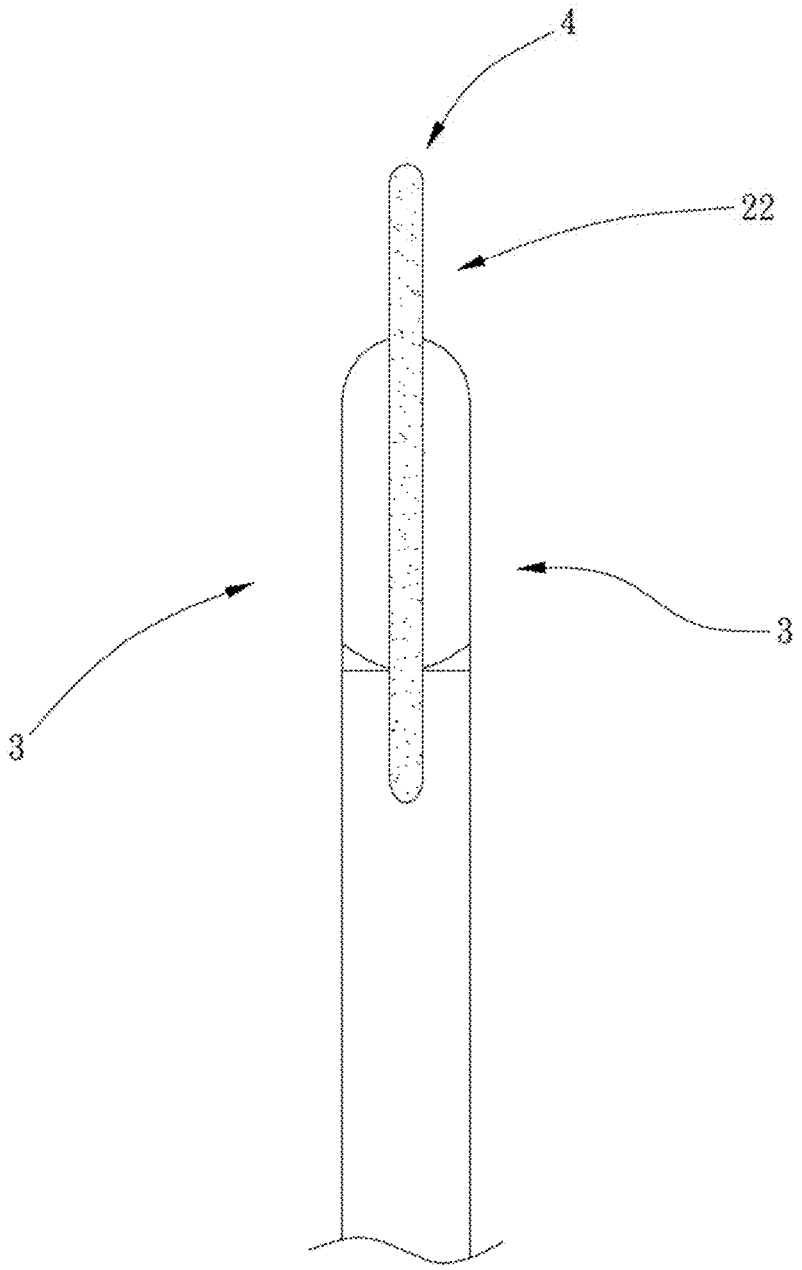
FIG. 8 is a side view of FIG. 7.
Figure 9:
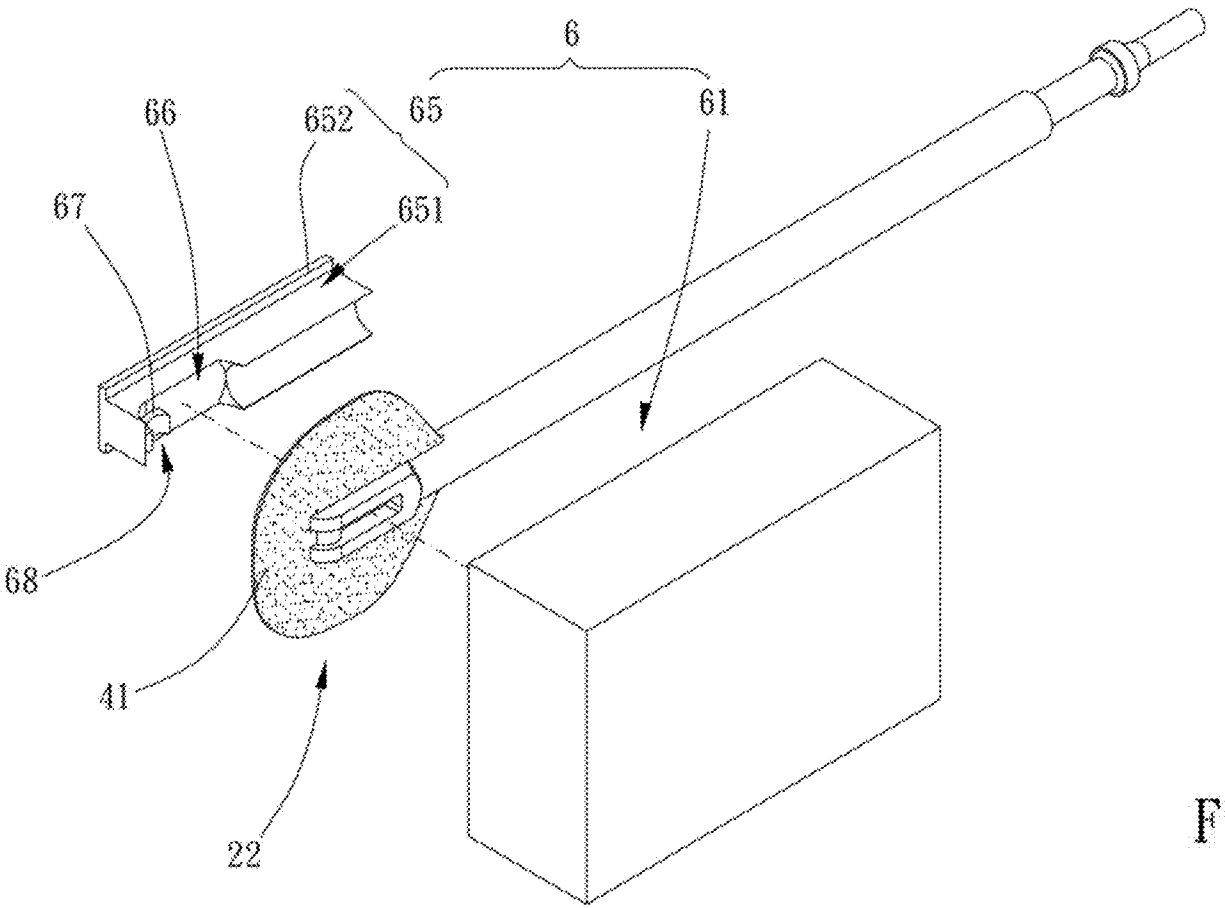
FIG. 9 is a drawing showing a first cutout assembly of the embodiment of the present invention in use.
Figure 10:
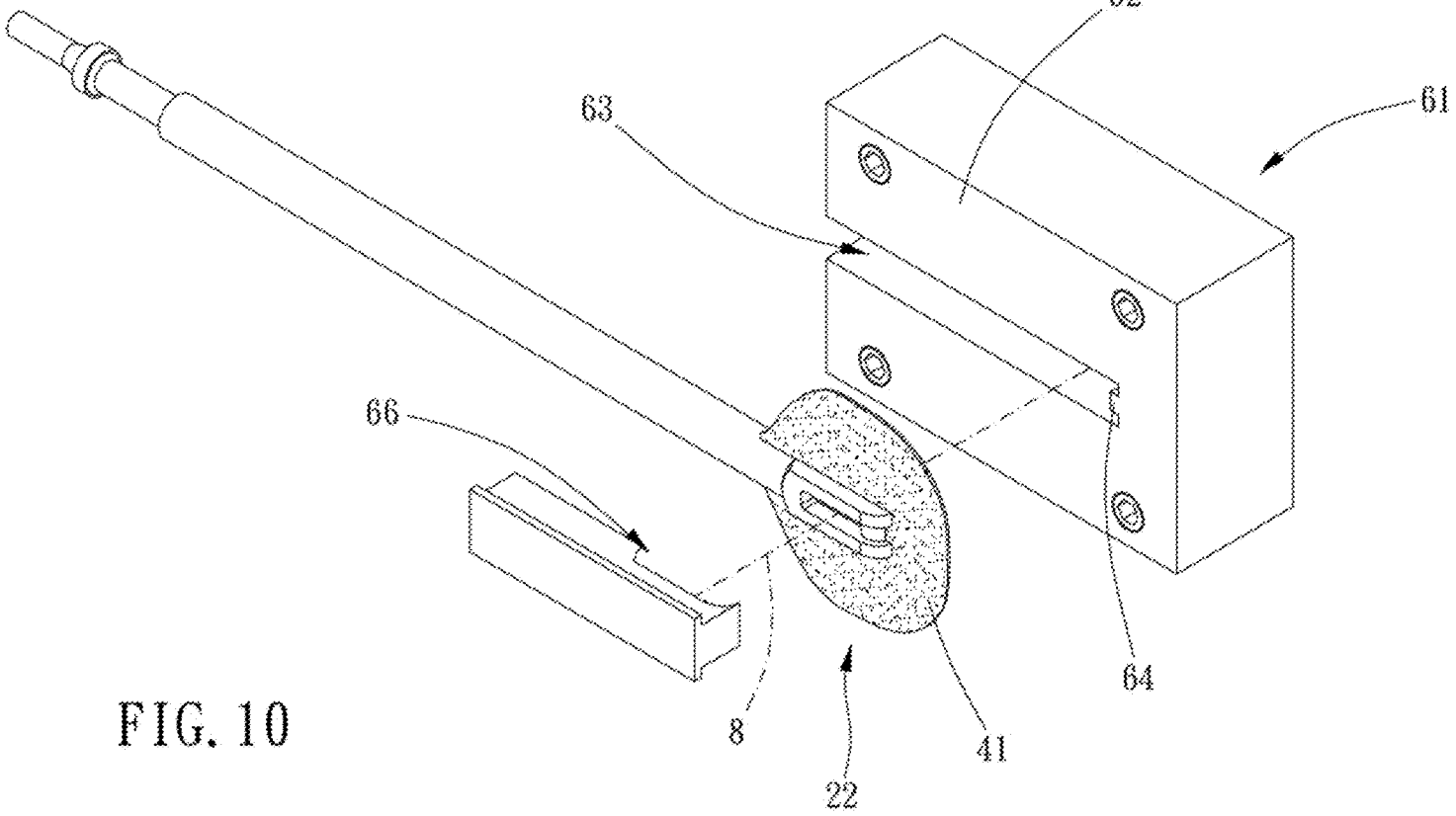
FIG. 10 is a drawing showing another perspective of FIG. 9.
Figure 11:
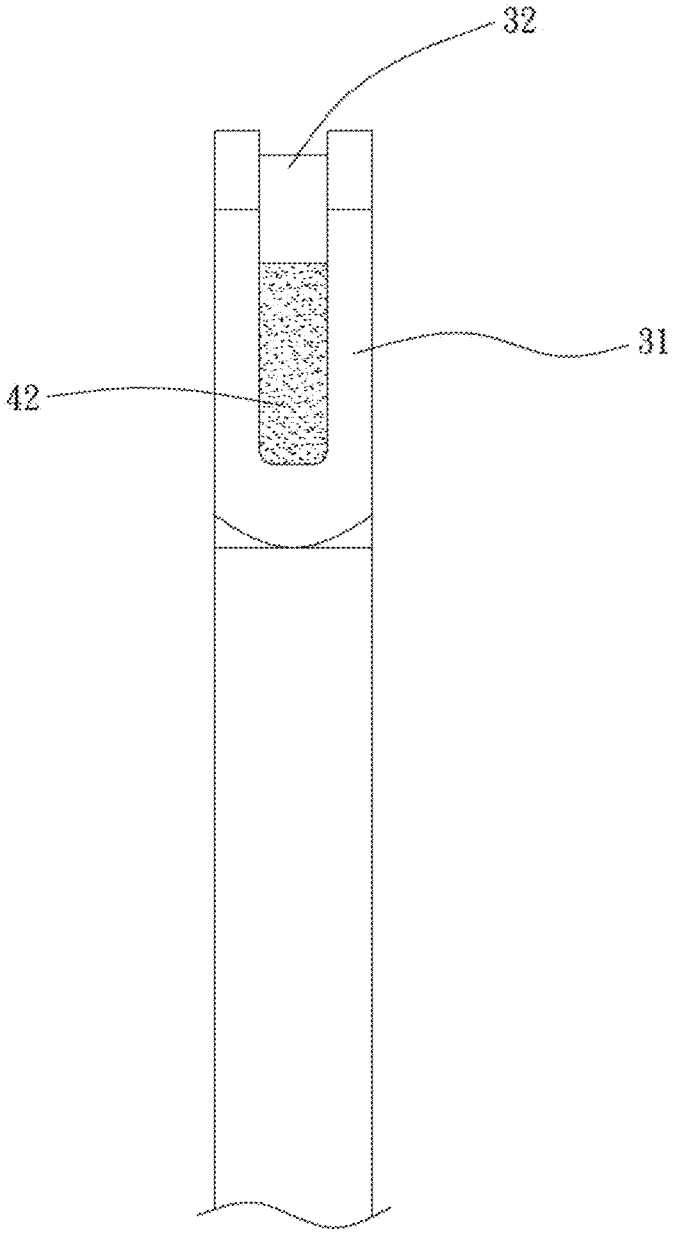
FIG. 11 is a drawing showing the embodiment of the present invention with a first remainder portion being cutout.
Figure 12:
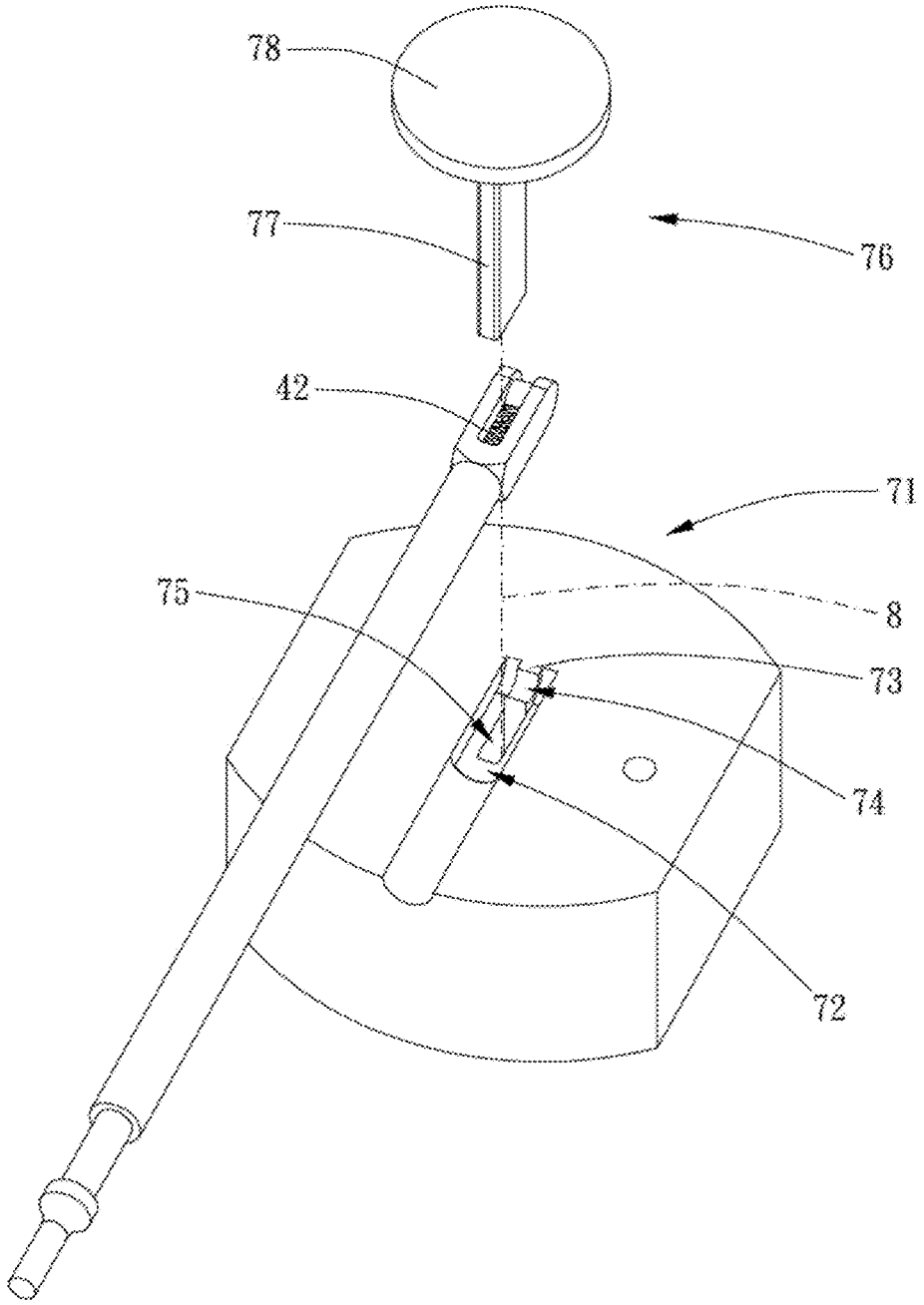
FIG. 12 is a drawing showing the embodiment of the present invention with a second remainder portion being cutout.
Figure 13:
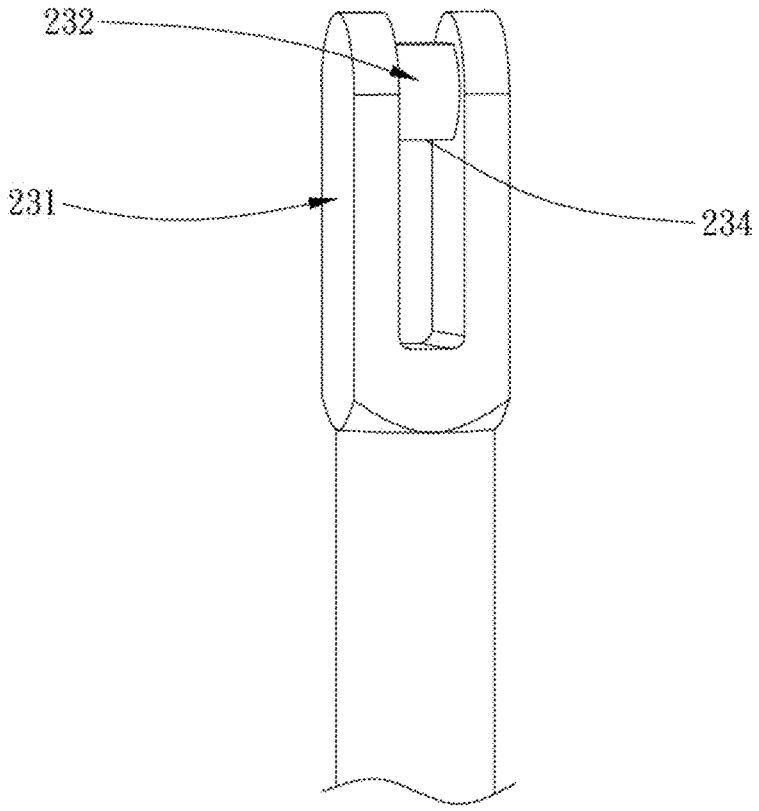
FIG. 13 is a drawing showing a finished product of a head portion of the embodiment of the present invention.

Please refer to FIGS. 1 to 13 for an embodiment of a method for manufacturing an operation rod of a wrench assembly for disassembling a fan clutch, including following steps of: firstly, preparing a rod material 1, the rod material 1 includes a rod body 11 and a head portion 21 which is connected to the rod body 11; fixing the rod material on a forging mold; and the head portion 21 is a solid cylinder.

Secondly, carrying out a forging process, making the forging mold 5 impact and press the head portion 21 along a processing direction 8 to produce a semi-finished head 22, the semi-finished head 22 includes two semi-finished structures 3 and a remainder structure 4 which is connected to the two semi-finished structures 3, the remainder structure 4 extends in a flat shape, and the two semi-finished structures 3 are connected to two opposite side faces of the remainder structure 4 on the processing direction 8. Specifically, each said semi-finished structure 3 includes two ear portions 31 and a semi-cylinder 32, the two ear portions 31 are arranged spacingly on a direction lateral to the processing direction 8, and the semi-cylinder 32 is connected to the two ear portions 31 to define an interior space 33. More specifically, the remainder structure 4 includes a first remainder portion 41 and a second remainder portion 42, the first remainder portion 41 is outside of the interior space 33, and the second remainder portion 42 is located in the interior space 33 and connected to the semi-cylinder 32 and the two ear portions 31.

It is to be noted that during the forging process, the second remainder structure 42 is a necessary structure which is left on purpose. During the process of the head portion 21 being shaped and deformed, the second remainder structure 42 can effectively support structures and shapes of the semi-cylinder 32 and the two ear portions 31 and maintain distances among the structures. In one word, the second remainder portion 42 within the interior space 33 can prevent the semi-cylinder 32 and the two ear portions 31 from being twisted or broken during the forging process so as to improve the quality and yield rate.

Lastly, carrying out a cutout process, cutting the remainder structure 4 out of the semi-finished head 22 to get a finished product of a head portion 23. The head portion 23 includes two wing plates 231 and a shaft 232, each said wing plate 231 is constructed by the two ear portions 31 of the two semi-finished structures 3 neighboring to each other on the processing direction 8, and the shaft 232 is constructed by the two semi-cylinders 32 of the two semi-finished structures 3.

The forging mold 5 includes two bases 51 which are movable along the processing direction 8, each said base 51 includes a positioning groove 53, a first forming groove 54, a second forming groove 55 and a protrusion 56, the positioning groove 53 is communicable to the first forming groove 54, the protrusion 56 is disposed on a bottom of the first forming groove 54 and extends toward an opening of the first forming groove 54, the protrusion 56 makes the first forming groove 54 to be U-shaped, the second forming groove 55 is disposed on the protrusion 56 and communicable to the first forming groove 54, the rod-positioning rod 53 is for receiving the rod body 11, the first forming groove 54 is for receiving the two ear portions 31, and the second forming groove 55 is for receiving the semi-cylinder 32; wherein a depth of the first forming groove 54 is greater than a depth of the second forming groove 55 and greater than a depth of the positioning groove 53, and the protrusion 56 is located lower than the opening of the first forming groove 54.

Preferably, each said base 51 further includes a receiving chamber 52, the positioning groove 53, the first forming groove 54 and the second forming groove 55 are disposed on a bottom of the receiving chamber 52, the first remainder portion 41 extends from the receiving chamber 52, the receiving chamber 52 isolate external interference and provides enough space for the first remainder portion 41 to extend therein, and the bottom of the receiving chamber 52 supports the first remainder portion 41 to allow the first remainder portion 41 to expand outwardly smoothly. On an extension direction of the positioning groove 53, a side of the first forming groove 54 opposite to the positioning groove 53 protrudes beyond the second forming groove 55.

In the cutout step, in this embodiment, a first cutout assembly 6 is provided to separate the first remainder portion 41 out, the first cutout assembly 6 further cuts the semi-cylinder 32 of the two semi-finished structures 3 to form a first plane 233, and the first plane 233 is outside of the interior space 33 and opposite to the rod body 11.

More specifically, the first cutout assembly 6 includes a first seat body 61 and a second seat body 65, the first seat body 61 includes a carrying face 62, a first positioning groove 63 and a tangent plane knife portion 64, the first positioning groove 63 is disposed on the carrying face 62, the tangent plane knife portion 64 protrudes beyond a wall of the first positioning groove 63 along a direction lateral to an opening direction of the first positioning groove 63, the second seat body 65 includes a second positioning groove 66 and a positioning seat 67, the positioning seat 67 is disposed on a bottom wall of the second positioning groove 66, a side of the positioning seat 67 which is opposite to a bottom of the second positioning groove 66 has a third positioning groove 68, and the third positioning groove 68 is communicable to the second positioning groove 66.

Before the cutout step, the two ear portions 31 of a first one of the two semi-finished structures 3 are received in the first positioning groove 63 and located by two opposite sides of the tangent plane knife portion 64, a part of the semi-cylinder 32 of the first one of the two semi-finished structures 3 is abutted against the tangent plane knife portion 64 along the processing direction 8, and the first remainder portion 41 is abutted against the carrying face 62. The two ear portions 31 of a second one of two semi-finished structures 3 are received in the second positioning groove 66 and located by two opposite sides of the positioning seat 67, and a part of the semi-cylinder 32 of the second one of the two semi-finished structures 3 is received in the third positioning groove 68. Finally, the first seat body 61 and the second seat body 65 move toward each other along the processing direction 8 until the second seat body 65 enters the first positioning groove 63, an edge of the first positioning groove 63 and an edge of the second positioning groove 66 cut the first remainder portion 41 out, and the tangent plane knife portion 64 cuts the semi-cylinder 32 of the two semi-finished structures 3 to form the first plane 233.

More specifically, the second seat body 65 includes a main body 651 and a first blocking flange 652, the first blocking flange 652 protrudes beyond the main body 651 laterally, the main body 651 has the second positioning groove 66 and the positioning seat 67, and when the first seat body 61 and the second seat body 65 move toward each other along the processing direction 8, the main body 651 extends within the first positioning groove 63, and the first blocking flange 652 is abutted against the carrying face 62 to control a passage of the first seat body 61 and the second seat body 65 moving toward each other.

In the cutout process, in this embodiment, a second cutout assembly 7 is provided to separate the second remainder portion 42 out to form the two wing plates 231, the second cutout assembly 7 further cuts the semi-cylinder 32 of the two semi-finished structures 3 to form a second plane 234, and the second plane 234 is within the interior space 33 and faces the rod body 11.

Specifically, the second cutout assembly 7 includes a third seat body 71 and a fourth seat body 76, the third seat body 71 includes a fourth positioning groove 72, a carrying base 73 and a through hole 75, the carrying base 73 protrudes beyond a bottom wall of the fourth positioning groove 72, the carrying base 73 has a fifth positioning groove 74 along the processing direction 8, the fifth positioning groove 74 is communicable to the fourth positioning groove 72, the through hole 75 is disposed through the bottom wall of the fourth positioning groove 72 and neighboring to the carrying base 73; on the contrary, the fourth seat body 76 includes a cutout portion 77 which extends cylindrically, and a profile of the cutout portion 77 matches a profile of the through hole 75.

Before carrying out the cutout process, two ear portions 31 of one of the two semi-finished structures 3 are received in the fourth positioning groove 72, the two ear portions 31 are located by two opposite sides of the carrying base 73 and the through hole 75, a part of the semi-cylinder 32 of the one of the two semi-finished structures 3 is received in the fifth positioning groove 74, and the second remainder portion 42 faces right to through hole 75. Lastly, the third seat body 71 and the fourth seat body 76 move toward each other along the processing direction 8 to allow the cutout portion 77 to enter the interior space 33 and project into the through hole 75 and further to separate the second remainder portion 42 from the semi-cylinder 32 and the two ear portions 31, and the cutout portion 77 cuts the semi-cylinder 32 of the two semi-finished structures 3 to form the second plane 234.

More specifically, the fourth seat body 76 further includes a second blocking flange 78, the second blocking flange 78 protrudes beyond the cutout portion 77 laterally, when the third seat body 71 and the fourth seat body 76 move toward each other along the processing direction 8, the cutout portion 77 passes the fourth positioning groove 72 and enters the through hole 75, and the second blocking flange 78 is abutted against the third seat body 71 to control a passage of the third seat body 71 and the fourth seat body 76 moving toward each other.

A wrench assembly for disassembling a fan clutch is further provided, including a wrench member 9 and an operation rod.

The wrench member 9 includes an assembling portion 92 and a hook portion 91 which is connected to the assembling portion 92, and the assembling portion 92 is disposed through an engagement hole 93 which is for being engaged with a fastener of the fan clutch; the operation rod includes the rod body 11 and the head portion 23 which is connected to the rod body 11, the rod body 11 includes the two wing plates 231 and the shaft 232 which are integrally formed, and the hook portion 91 of the wrench member 9 is rotatably hooked on the shaft 232.

Specifically, each of two opposite sides of the shaft 232 respectively has the first plane 233 and the second plane 234, and an axis of the rod body 11 extends and passes through the first plane 233 and the second plane 234. The hook portion 91 has a passage 94 and a positioning receiving portion 95 which is communicable to the passage 94, the passage 94 extends linearly, and an inner profile of the positioning receiving portion 95 is round. More specifically, an inner diameter of the positioning receiving portion 95 is greater than a width of the passage 94, a vertical distance between the first plane 233 and the second plane 234 is equal to or smaller than the width of the passage, and a greatest distance between the other two sides of the shaft 232 is greater than the width of the passage 94. Hence, the shaft 232 can only passes through the passage 94 in a specific angle, that is, when the first plane 233 and the second plane 234 respectively faces a wall of the passage 94, with this limitation, an engagement stability of the wrench member 9 and the operation rod can be effectively elevated, and the wrench member 9 and the operation rod will not detach from each other easily during the operation process.

While we have shown and described various embodiments in accordance with the present invention, it should be clear to those skilled in the art that further embodiments may be made without departing from the scope of the present invention.

What is claimed is:

1. A method for manufacturing an operation rod of a wrench assembly for disassembling a fan clutch, including following steps of:

preparing a rod material, the rod material including a rod body and a head portion which is connected to the rod body;

fixing the rod material on a forging mold;

carrying out a forging process, making the forging mold impact and press the head portion along a processing direction to produce a semi-finished head, the semi-finished head including two semi-finished structures and a remainder structure which is connected to the two semi-finished structures, the remainder structure extending in a flat shape, the two semi-finished structures being connected to two opposite side faces of the remainder structure on the processing direction, each said semi-finished structure including two ear portions and a semi-cylinder, the two ear portions being arranged spacingly on a direction lateral to the processing direction, the semi-cylinder being connected to the two ear portions to define an interior space, the remainder structure including a first remainder portion and a second remainder portion, the first remainder portion being outside of the interior space, the second remainder portion being located in the interior space and connected to the semi-cylinder and the two ear portions;

carrying out a cutout process, cutting the remainder structure out of the semi-finished head;

obtaining a finished product of a head portion, the head portion including two wing plates and a shaft, each said wing plate being constructed by the two ear portions of the two semi-finished structures neighboring to each other on the processing direction, the shaft being constructed by the two semi-cylinders of the two semi-finished structures;

wherein in the cutout step, a first cutout assembly is provided to separate the first remainder portion out, the first cutout assembly further cuts the semi-cylinder of the two semi-finished structures to form a first plane, and the first plane is outside of the interior space and opposite to the rod body;

wherein the first cutout assembly includes a first seat body and a second seat body, the first seat body includes a carrying face, a first positioning groove and a tangent plane knife portion, the first positioning groove is disposed on the carrying face, the tangent plane knife portion protrudes beyond a wall of the first positioning groove along a direction lateral to an opening direction of the first positioning groove, the second seat body includes a second positioning groove and a positioning seat, the positioning seat is disposed on a bottom wall of the second positioning groove, a side of the positioning seat which is opposite to a bottom of the second positioning groove has a third positioning groove, and the third positioning groove is communicable to the second positioning groove; wherein the two ear portions of a first one of the two semi-finished structures are received in the first positioning groove and located by two opposite sides of the tangent plane knife portion, a part of the semi-cylinder of the first one of the two semi-finished structures is abutted against the tangent plane knife portion along the processing direction, and the first remainder portion is abutted against the carrying face; the two ear portions of a second one of two semi-finished structures are received in the second positioning groove and located by two opposite sides of the positioning seat, and a part of the semi-cylinder of the second one of the two semi-finished structures is received in the third positioning groove; the first seat body and the second seat body move toward each other along the processing direction until the second seat body enters the first positioning groove, an edge of the first positioning groove and an edge of the second positioning groove cut the first remainder portion out, and the tangent plane knife portion cuts the semi-cylinder of the two semi-finished structures to form the first plane.

2. The method for manufacturing the operation rod of the wrench assembly for disassembling the fan clutch of claim 1, wherein the forging mold includes two bases which are movable along the processing direction, each said base includes a positioning groove, a first forming groove, a second forming groove and a protrusion, the positioning groove is communicable to the first forming groove, the protrusion is disposed on a bottom of the first forming groove and extends toward an opening of the first forming groove, the second forming groove is disposed on the protrusion and communicable to the first forming groove, the positioning groove is for receiving the rod body, the first forming groove is for receiving the two ear portions, and the second forming groove is for receiving the semi-cylinder; wherein a depth of the first forming groove is greater than a depth of the second forming groove and greater than a depth of the positioning groove, and the protrusion is located lower than the opening of the first forming groove.

3. The method for manufacturing the operation rod of the wrench assembly for disassembling the fan clutch of claim 1, wherein the forging mold includes two bases which are movable along the processing direction, each said base includes the positioning groove, the first forming groove, the second forming groove and the protrusion, the positioning groove is communicable to the first forming groove, the protrusion is disposed on the bottom of the first forming groove and extends toward an opening of the first forming groove, the second forming groove is disposed on the protrusion and communicable to the first forming groove, the positioning groove is for receiving the rod body, the first forming groove is for receiving the two ear portions, and the second forming groove is for receiving the semi-cylinder; wherein the depth of the first forming groove is greater than the depth of the second forming groove and greater than the depth of the positioning groove, and the protrusion is located lower than the opening of the first forming groove; in the cutout process, the second cutout assembly is provided to separate the second remainder portion out to form the two wing plates, the second cutout assembly further cuts the semi-cylinder of the two semi-finished structures to form the second plane, and the second plane is within the interior space and faces the rod body; the second cutout assembly includes the third seat body and the fourth seat body, the third seat body includes the fourth positioning groove, the carrying base and the through hole, the carrying base protrudes beyond the bottom wall of the fourth positioning groove, the carrying base has the fifth positioning groove along the processing direction, the fifth positioning groove is communicable to the fourth positioning groove, the through hole is disposed through the bottom wall of the fourth positioning groove and neighboring to the carrying base, the fourth seat body includes the cutout portion which extends cylindrically, the profile of the cutout portion matches the profile of the through hole, two ear portions of one of the two semi-finished structures are received in the fourth positioning groove, the two ear portions are located by two opposite sides of the carrying base and the through hole, a part of the semi-cylinder of the one of the two semi-finished structures is received in the fifth positioning groove, and the second remainder portion faces right to through hole; the third seat body and the fourth seat body move toward each other along the processing direction to allow the cutout portion to enter the interior space and project into the through hole and further to separate the second remainder portion from the semi-cylinder and the two ear portions, and the cutout portion cuts the semi-cylinder of the two semi-finished structures to form the second plane; on an extension direction of the positioning groove, a side of the first forming groove opposite to the positioning groove protrudes beyond the second forming groove; each said base further includes a receiving chamber, the positioning groove, the first forming groove and the second forming groove are disposed on a bottom of the receiving chamber, and the first remainder portion extends from the receiving chamber; the first forming groove is U-shaped; when the first seat body and the second seat body move toward each other along the processing direction, the main body extends within the first positioning groove, the first positioning groove, and the first blocking flange is abutted against the carrying face to control a passage of the first seat body and the second seat body moving toward each other; the fourth seat body further includes a second blocking flange, and the second blocking flange protrudes beyond the cutout portion laterally.

4. A method for manufacturing an operation rod of a wrench assembly for disassembling a fan clutch, including following steps of:

preparing a rod material, the rod material including a rod body and a head portion which is connected to the rod body;

fixing the rod material on a forging mold;

carrying out a forging process, making the forging mold impact and press the head portion along a processing direction to produce a semi-finished head, the semi-finished head including two semi-finished structures and a remainder structure which is connected to the two semi-finished structures, the remainder structure extending in a flat shape, the two semi-finished structures being connected to two opposite side faces of the remainder structure on the processing direction, each said semi-finished structure including two ear portions and a semi-cylinder, the two ear portions being arranged spacingly on a direction lateral to the processing direction, the semi-cylinder being connected to the two ear portions to define an interior space, the remainder structure including a first remainder portion and a second remainder portion, the first remainder portion being outside of the interior space, the second remainder portion being located in the interior space and connected to the semi-cylinder and the two ear portions;

carrying out a cutout process, cutting the remainder structure out of the semi-finished head; obtaining a finished product of a head portion, the head portion including two wing plates and a shaft, each said wing plate being constructed by the two ear portions of the two semi-finished structures neighboring to each other on the processing direction, the shaft being constructed by the two semi-cylinders of the two semi-finished structures;

wherein in the cutout process, a second cutout assembly is provided to separate the second remainder portion out to form the two wing plates, the second cutout assembly further cuts the semi-cylinder of the two semi-finished structures to form a second plane, and the second plane is within the interior space and faces the rod body;

wherein the second cutout assembly includes a third seat body and a fourth seat body, the third seat body includes a fourth positioning groove, a carrying base and a through hole, the carrying base protrudes beyond a bottom wall of the fourth positioning groove, the carrying base has a fifth positioning groove along the processing direction, the fifth positioning groove is communicable to the fourth positioning groove, the through hole is disposed through the bottom wall of the fourth positioning groove and neighboring to the carrying base, the fourth seat body includes a cutout portion which extends cylindrically, a profile of the cutout portion matches a profile of the through hole, two ear portions of one of the two semi-finished structures are received in the fourth positioning groove, the two ear portions are located by two opposite sides of the carrying base and the through hole, a part of the semi-cylinder of the one of the two semi-finished structures is received in the fifth positioning groove, and the second remainder portion faces right to through hole; the third seat body and the fourth seat body move toward each other along the processing direction to allow the cutout portion to enter the interior space and project into the through hole and further to separate the second remainder portion from the semi-cylinder and the two ear portions, and the cutout portion cuts the semi-cylinder of the two semi-finished structures to form the second plane.

* * * * *